United States Patent [19]

Rottier

[11] 4,152,628

[45] May 1, 1979

[54] CIRCUIT ARRANGEMENT FOR STARTING AND FEEDING A GAS AND/OR VAPOR DISCHARGE LAMP

[75] Inventor: Jacob Rottier, Eindhoven, Netherlands

[73] Assignee: U.S. Philips Corporation, New York, N.Y.

[21] Appl. No.: 868,808

[22] Filed: Jan. 12, 1978

[30] Foreign Application Priority Data

Jan. 26, 1977 [NL] Netherlands ..... 7700764

[51] Int. Cl.[2] ..... H05B 41/18

[52] U.S. Cl. ..... 315/244; 315/101; 315/106; 315/200 R; 315/207

[58] Field of Search ..... 315/100, 101, 106, 107, 315/119, 125, 127, 200 R, 207, 227 R, 244, DIG. 5

[56] References Cited

U.S. PATENT DOCUMENTS

| | | | |
|---|---|---|---|
| 3,643,127 | 2/1972 | Laupman | 315/106 X |
| 3,760,224 | 9/1973 | Shimizu et al. | 315/101 X |
| 3,983,449 | 9/1976 | Dear et al. | 315/244 |

FOREIGN PATENT DOCUMENTS

| | | | |
|---|---|---|---|
| 2452260 | 4/1976 | Fed. Rep. of Germany | 315/101 |
| 2514321 | 10/1976 | Fed. Rep. of Germany | 315/106 |

*Primary Examiner*—Eugene R. LaRoche

*Attorney, Agent, or Firm*—Thomas A. Briody; Bernard Franzblau

[57] ABSTRACT

The invention relates to a relay starter for a discharge lamp wherein the lamp is stabilized by a series arrangement of at least an inductor and a capacitance. Also included in series with these stabilization elements and the lamp is an energizing winding of a relay having a normally-closed contact disposed in a circuit which shunts the lamp.

A diode is also disposed in the circuit which shunts the lamp, so that if the lamp does not ignite, current flows for a short period of time through the diode which thereby charges the capacitor. When this capacitor has received a sufficient charge no further current flows either in the lamp circuit or in the shunting circuit so that the entire circuit is put out of operation.

2 Claims, 1 Drawing Figure

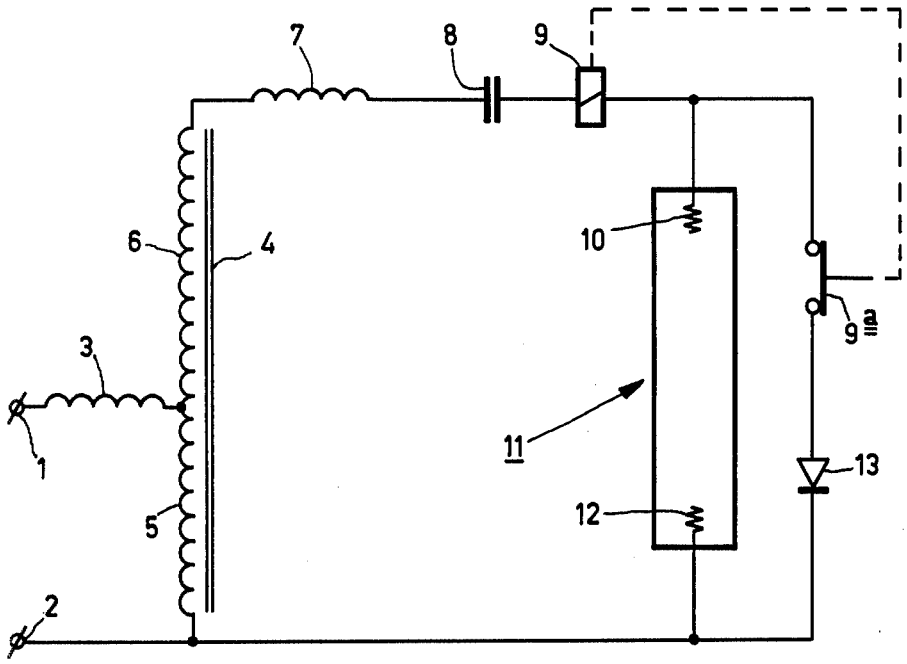
7
8
9
6
4
10
9a
3
1
11
13
5
12
2

CIRCUIT ARRANGEMENT FOR STARTING AND FEEDING A GAS AND/OR VAPOR DISCHARGE LAMP

The invention relates to a circuit arrangement for starting and feeding a gas and/or vapour discharge lamp provided with two electrodes. The circuit arrangement is provided with two input terminals intended for connection to an a.c. voltage source and the input terminals are inerconnected by means of a series arrangement of at least an electric coil, a capacitor and the lamp. The lamp is shunted by a starting auxiliary circuit comprising a normally-closed relay contact, an energizing winding of the relay being included in said series arrangement.

A known circuit arrangement of the type indicated is, for example, disclosed in U.S. Pat. No. 2,897,403. A disadvantage of that prior art circuit arrangement is that if the lamp is defective the lamp shunt circuit, and consequently also the stabilization ballast of the lamp, continue to carry current. This results in losses, which is a disadvantage. It should be noted that the above stabilization ballast consists of a series arrangement of an electric coil and a capacitor.

It is an object of the invention to provide a simple solution for a circuit arrangement of the type mentioned in the preamble in which in the case of a defective lamp no current flows through the circuit anymore.

A circuit arrangement according to the invention for starting and feeding a gas and/or vapour discharge lamp provided with two electrodes, comprises two input terminals intended for connection to an a.c. voltage source with the input terminals interconnected by means of a series arrangement of at least an electric coil, a capacitor and the lamp. The lamp is shunted by a starting auxiliary circuit comprising a normally-closed relay contact with an energizing winding of the relay being included in said series arrangement. A rectifier is included in the auxiliary circuit in series with the relay contact.

An advantage of a circuit arrangement according to the invention is that in the case of a defective lamp the capacitor is charged through the rectifier whereafter substantially no further current flows in the circuit.

An embodiment of the invention will be further explained with reference to the accompanying drawing the single FIGURE of which shows an electric circuit of a device according to the invention.

In the circuit references 1 and 2 indicate input terminals intended for connection to an a.c. voltage source of approximately 220 V, 50 Hz. An indicator 3 is connected to the input terminal 1. The other side of the inductor 3 is connected to a tap of an auto-transformer 4. In the operating condition of the lamp, to be indicated hereinafter, this transformer is brought to the saturated state. Such a transformer—which is brought to the saturated state—has been chosen to realize therewith an electric lamp current which results in a high luminous eficacy (for example expressed in lumen/watt). A primary winding 5 of the transformer 4 is connected between the tap and the input terminal 2. A winding 6 of the transformer 4 is connected between the tap and a further inductor 7. In addition the other end of the inductor 7 is connected to a capacitor 8. In its turn the capacitor 8 is connected to the energizing winding of a relay 9. The other side of this relay 9 is connected to an electrode 10 of a low-pressure sodium vapour discharge lamp 11. This lamp 11 is shown diagrammatically only. In reality this lamp will not only be provided with a discharge tube, but also, for example, with an outer bulb enveloping this tube. A second electrode 12 of the lamp 11 is connected to the input terminal 2. The lamp 11 is shunted by a series arrangement of a contact **9*a* of the relay 9, and a diode 13**.

This circuit operates as follows. If the terminals 1 and 2 are connected to the indicated a.c. voltage source a current will flow via the winding 6 and the coil 7 through the capacitor 8 and the relay 9 and the contact **9*a*, which is initially closed, and furthermore through the diode 13 to the terminal 2. This of course only occurs in those half cycles of the a.c. voltage supply in which the terminal 1 is positive relative to the terminal 2. Said current charges the capacitor 8. In the opposite half cycles of the a.c. voltage supply the summed value of the voltages across inductors 5 and 6 are across the capacitor 8 is applied between the lamp electodes 12 and 10. In this situation the lamp 11 is ready for starting. If then a discharge takes place between the electrodes 12 and 10 such a large current flows through the relay 9 that the contact 9*a* is opened. If—owing to a certain inertia—this contact opens in the beginning of the next half cycle an additional voltage peak is produced across the lamp owing to the inductance in that circuit. This additional voltage peak promotes restarting of the lamp in that half cycle. This then results in the definite ignition of the lamp 11**.

Should, however, the lamp extinguish thereafter than the relay 9 becomes currentless again so that the contact **9*a* closes again and the originally indicated current circuit 1, 3, 6, 7, 8, 9, 9*a*, 13, 2** is reinstated. Thereafter the above starting procedure repeats itself.

If the pump 11 is definitely ignited the current will flow through the lamp 11 via the winding 6, the coil 7, the capacitor 8 and the relay 9. In this situation the contact **9*a* remains open owing to the lamp current which flows through the relay 9. So the lamp shunting circuit 9*a*, 13** is then interrupted. As a consequence no losses can occur in this lamp shunt.

Now a case will be considered in which a disturbance occurs. If for some reason or other the lamp 11 absolutely refuses to ignite, for example because it is an old lamp or if no lamp is present, the capacitor 8 will be charged via the diode 13—as also described above—. This continues until the capacitor has assumed a potential with which a further charging current is no longer possible. Then, however—because the lamp 11 does not ignite—the circuit **6, 7, 8, 9, 9*a*, 13 will become substantially currentless. An advantage of this circuit is therefore that if the lamp 11** refuses to ignite no further current will flow after a short period of time, neither in the lamp current circuit nor in the starting circuit.

In one embodiment the lamp 11 is a low-pressure sodium vapour discharge lamp of approximately 135 W. The inductance of coil 3 is approximately 0.4 Henry. The winding 5 has approximately 540 turns and the winding 6 approximately 440 turns. The inductance of coil 7 is 20 mHenry. In this embodiment the coils 3 and 7 are wound on the same core. The capacitance of the capacitor 8 is approximately 6.6 $\mu$Farad.

In this described embodiment, in the case of a lamp 11 which does not ignite, the circuit will carry substantially no further current after approximately three half cycles of the a.c. supply.

I claim:

1. A circuit arrangement for starting and feeding a gas and/or vapour discharge lamp provided with two electrodes, the circuit arrangement comprising two input terminals intended for connection to an a.c. voltage source, the input terminals being interconnected by a series arrangement of at least an electric coil, a capacitor, an energizing winding of a relay and the lamp, the lamp being shunted by a starting auxiliary circuit comprising a normally-closed contact of the relay and a rectifier connected in series with the relay contact.

2. A circuit arrangement as claimed in claim 1 wherein said series arrangement further comprises a transformer designed to operate in the saturated state at the value of the normal operating current of the discharge lamp.

* * * * *